US005715323A

United States Patent [19]

Walker

[11] Patent Number: 5,715,323

[45] Date of Patent: Feb. 3, 1998

[54] RADIO ATTACHABLE TO SPECTACLES

[76] Inventor: John D. Walker, 1348 Stewart Blvd., Clearwater, Fla. 34624

[21] Appl. No.: 726,485

[22] Filed: Oct. 7, 1996

[51] Int. Cl.[6] ..... H04R 25/00

[52] U.S. Cl. ..... 381/187; 381/183; 381/68.5; 455/344; 351/123

[58] Field of Search ..... 381/187, 183, 381/68.5, 188, 205; 455/344, 346, 347, 348, 349, 350, 351, 90; 351/123, 156, 157, 158; 24/3.3, 3.12

[56] References Cited

U.S. PATENT DOCUMENTS

| | | | |
|---|---|---|---|
| 4,856,086 | 8/1989 | McCullough | 455/344 |
| 4,882,769 | 11/1989 | Gallimore | 455/344 |
| 4,901,355 | 2/1990 | Moore | 381/68.5 |
| 5,034,995 | 7/1991 | Ciccone | 455/344 |
| 5,606,743 | 2/1997 | Vogt et al. | 455/347 |
| 5,608,808 | 3/1997 | Da Silva | 381/68.5 |

*Primary Examiner*—Sinh Tran
*Attorney, Agent, or Firm*—Ronald E. Smith

[57] ABSTRACT

A miniature radio and two speakers, one for each ear, are releasably attachable to a pair of spectacles. The speakers are remote from the radio and connected to it through speaker wires. In a first embodiment, a truncate primary tube releasably engages a trailing end of each spectacle ear piece, and the radio is clipped to one of the primary tubes. All but the opposite ends of the speaker wires are housed within an elongate, flexible tube that interconnects the respective free ends of each truncate primary tube to one another. The elongate, flexible tube has exit openings at its opposite ends, and the opposite ends of the speaker wires extend through the exit openings and through respective auxiliary tubes that are secured to the primary tubes that engage the respective ear pieces of the spectacles. In this way, the spectacle ear pieces do not contact the opposite ends of the speaker wires when the ear pieces are inserted into the truncate primary tubes. In a second embodiment, the exit openings are eliminated and the speaker wires are housed between a pair of flaps that extend from the elongate, flexible tube. The opposite ends of the speaker wires enter the respective auxiliary tubes directly from the opposite ends of the flaps. In further embodiments, the elongate, flexible tube may be a flexible rod and the flaps are replaced by a tube.

11 Claims, 4 Drawing Sheets

RADIO ATTACHABLE TO SPECTACLES

BACKGROUND OF THE INVENTION

1. Field of the Invention

This invention relates, generally, to miniature radios and devices for holding them. More particularly, it relates to a miniature radio that is releasably mountable to spectacles.

2. Description of the Prior Art

A miniature radio is best enjoyed if the user need not hold it. Accordingly, several inventors have devised means for incorporating miniature radios into spectacles. A person wearing corrective lenses or noncorrective lenses such as sunglasses may then enjoy listening to a radio without needing to hold it.

U.S. Pat. No. 3,118,145 to Nee, for example, discloses a pair of spectacles having hollow temple members which house a miniature radio. Thus, the radio is not releasably attachable to the spectacles but is instead a permanent part of the spectacles.

Miniature speakers for a radio are attached to the temples of a pair of spectacles in U.S. Pat. No. 5,335,285 to Gluz. The speakers are slideably adjustable along the length of their associated temples and are directionally mountable so that the wearer can adjust them as needed. The radio itself is not mounted to the spectacles but is instead carried by the person at a location remote from the spectacles.

U.S. Pat. No. 5,020,150 to Shannon discloses a radio mounted atop the nose bridge area of a pair of spectacles, and the speakers are positioned at the end of wires which are secured to the inside walls of the respective temple members of the spectacles. Thus, the radio is a permanent part of the spectacles.

Ciconne, in U.S. Pat. No. 5,034,995, discloses a headband attachable to the trailing end of the temples, or ear pieces, of a pair of spectacles. A miniature radio is attached to the headband, and speaker wires extend through the headband from the radio to the opposite ends of the headband. Thus, when respective ear pieces are inserted into the opposite ends of the headband, the ear pieces rub against the speaker wires.

The Ciccone patent represents the art closest to the disclosure of the present invention. The sharing of the headband by the ear pieces and the speaker wires could result in wearing out of the speaker wires if the device is used frequently. What is needed, then, is a device similar to the Ciccone apparatus but which is not subject to its limitations.

However, at the time the present invention was made, it was not obvious to those of ordinary skill in this art how the limitations of the earlier devices could be overcome.

SUMMARY OF THE INVENTION

The longstanding but heretofore unfulfilled need for an apparatus that overcomes the shortcomings of the prior art is now met by a new, useful, and nonobvious invention. The present invention includes an assembly for releasably attaching a miniature radio to a pair of spectacles. A pair of speaker wires extend from a miniature radio to a pair of speakers positioned remote from the miniature radio. More particularly, a first speaker wire extends from the miniature radio to a first speaker and a second speaker wire extends from the miniature radio to a second speaker. A pair of truncate primary tubes have leading ends that are adapted to releasably engage trailing ends of respective ear pieces of the pair of spectacles, and the miniature radio is clipped to a preselected truncate primary tube of the pair of truncate primary tubes. An elongate, flexible tube extends between respective trailing ends of the truncate primary tubes in interconnecting relationship therewith; the elongate, flexible tube houses all but the opposite ends of the speaker wires. An exit opening is formed in opposite ends of the elongate, flexible tube adjacent each truncate primary tube and opposite ends of the speaker wires extend through the exit openings so that the opposite ends are not received within the truncate primary tubes. A truncate auxiliary tube is attached to each of the truncate primary tubes, and the opposite ends of the speaker wires extend through the truncate auxiliary tubes so that only the ear pieces occupy the truncate primary tubes when the assembly is attached to a pair of spectacles.

In a second embodiment, no extent of the speaker wires is housed within the elongate, flexible tube. Instead, all but the opposite ends of the speaker wires are housed in sandwiched relation to a pair of flap members that collectively form a flap that extends from the elongate, flexible tube along its length. The opposite ends of the flap are positioned adjacent the trailing ends of the auxiliary tubes so that the speaker wires extend directly from the flap into the auxiliary tubes and to their respective speakers.

In another alternative embodiment, the elongate, flexible tube is solid because the speaker wires are housed within the flap of the second embodiment.

In another alternative embodiment, the flap of the second embodiment is replaced by an elongate tube that houses the speaker wires. Thus, the truncate auxiliary tubes are combined into one elongate auxiliary tube that extends parallel to the elongate, flexible tube. Since the auxiliary tube houses the speaker wires, the elongate, flexible tube may be hollow or solid.

It is a primary object of this invention to provide a miniature radio that is releasably attachable to a pair of spectacles.

A more specific object is to provide a means whereby speaker wires associated with such a radio are not subjected to wear and tear by ear pieces.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
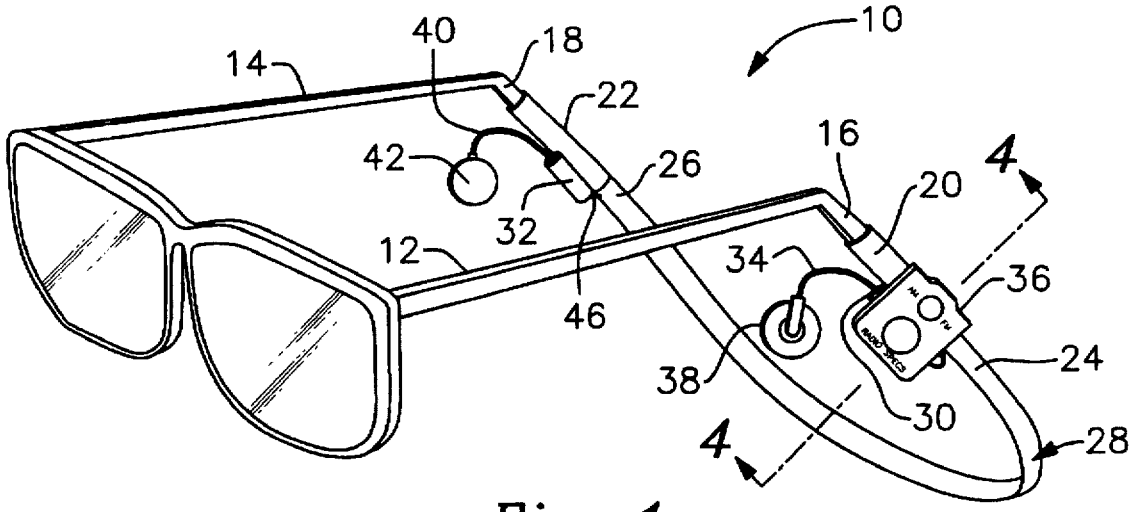
FIG. 1 is a perspective view of a preferred embodiment of the invention.
Figure 2:
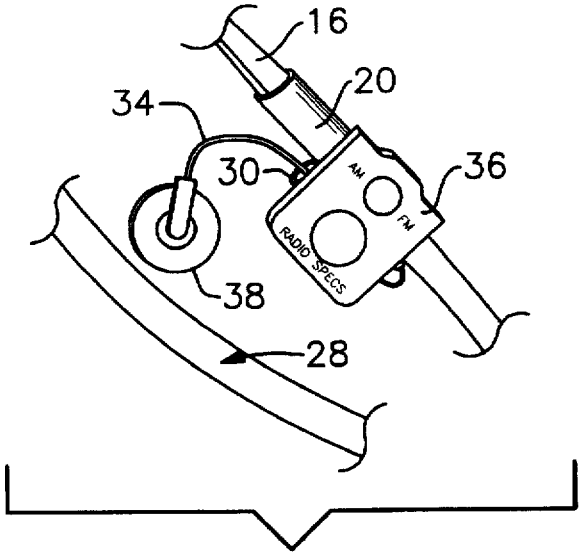
FIG. 2 is an enlarged front perspective view of a portion of said preferred embodiment.

Referring now to FIG. 1, it will there be seen that an exemplary embodiment of the invention is denoted as a whole by the reference numeral 10.

A conventional pair of spectacles 10 includes first and second temple members 12, 14 and first and second ear-engaging members or ear pieces 16, 18 secured to or formed integrally with the respective trailing ends of said temple members 12, 14.

The respective trailing ends of said ear pieces are slideably and releasably received within respective open leading ends of a first or primary pair of truncate tubular members 20, 22 when assembly 10 is attached to the spectacles. Significantly, as will be understood as this description continues, said ear pieces do not share said truncate tubes with any other parts of the invention, i.e., the speaker wires are not also present within said truncate tubes as in the art mentioned earlier. Accordingly, ear pieces 16, 18 may be inserted into the open leading ends of said truncate tubes 20, 22 as many times as desired in the absence of wear and tear on speaker wires.

Opposite ends 24, 26 of elongate, flexible tube 28 are received within and secured to respective trailing ends of said ear piece-engaging members 20, 22. Tube 28 enables a wearer of spectacles to remove them from their operable position and to suspend them from the neck.

A second or auxiliary pair of truncate tubular members 30, 32 is secured to respective ones of said primary pair of truncate tubes 20, 22, in substantially parallel relation thereto as depicted.

A first speaker wire 34 extends from miniature radio 36 to first speaker 38. Said wire 34 extends into auxiliary truncate tube 30 through an aperture formed therein and exits said member 30 through its leading end, terminating in said first speaker 38.

Figure 3:
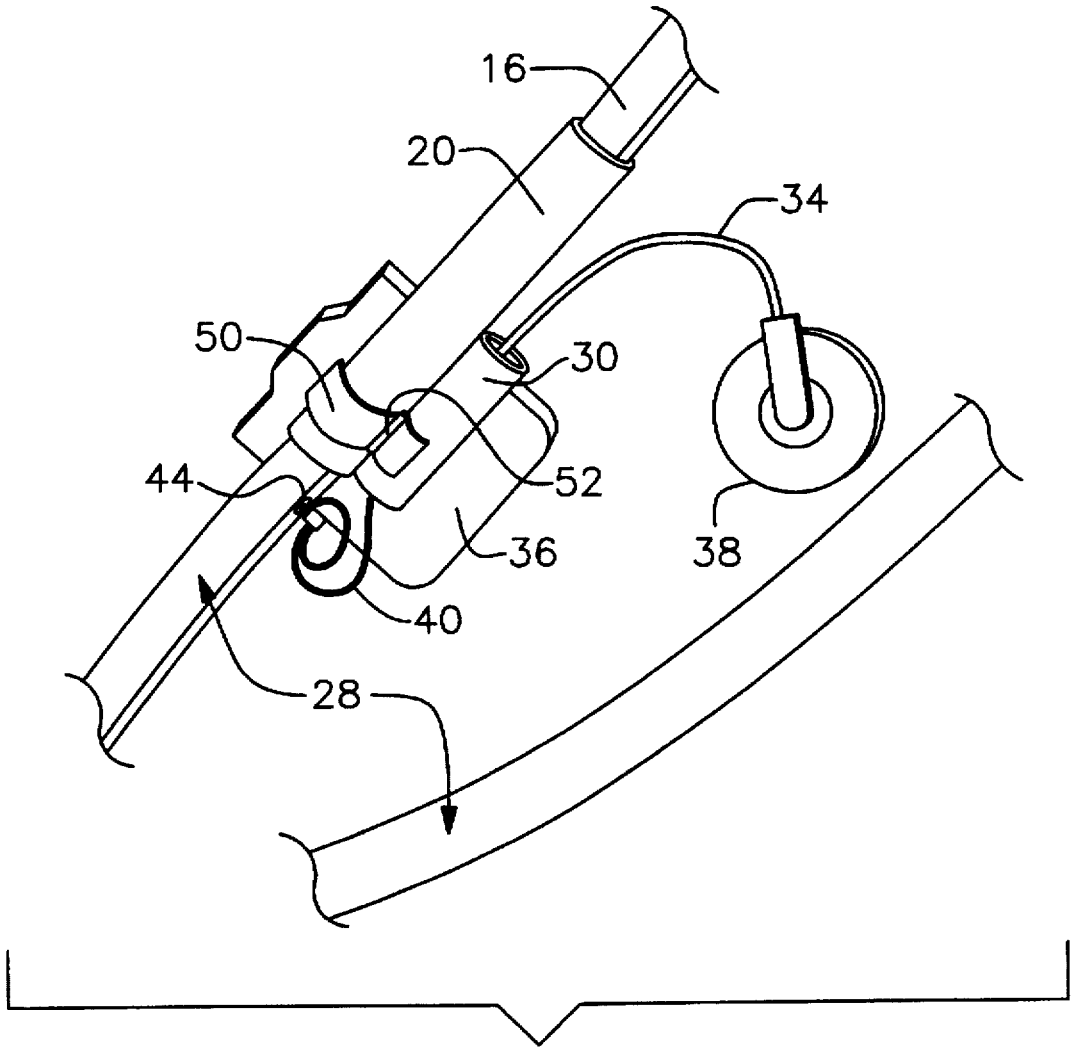
FIG. 3 is an enlarged rear perspective view of said portion.

A second speaker wire 40 extends from radio 36 to a remote second speaker 42. As best illustrated in FIG. 3, second speaker wire 40 enters elongate, flexible tube 28 at a first end thereof through exit opening 44 and, as best illustrated in FIG. 1, exits at a second end thereof through exit opening 46. Upon exiting said exit opening 46, said second speaker wire 40 extends through auxiliary truncate tube 32 and terminates in remote speaker 42. Thus, elongate, flexible tube 28 houses all but the opposite ends of speaker wires 34, 40.

In this way, the only structural members occupying respective primary truncate tubes 20, 22 are ear pieces 16, 18, respectively. The only structural members occupying auxiliary truncate tube 30 are first and second speaker wires 34, 40, and the only structural member occupying auxiliary truncate tube 32 is second speaker wire 40.

Figure 4:
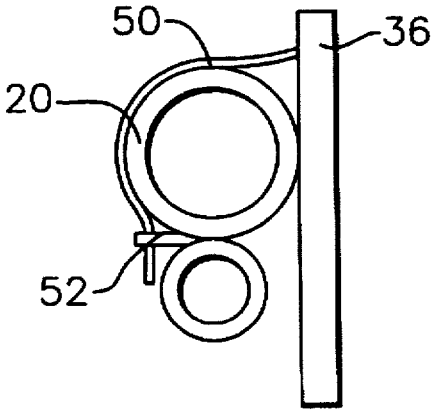
FIG. 4 is a sectional view taken along line 4—4 in FIG. 1.

As indicated in FIG. 4, a flexible and resilient clip 50 is secured to radio 36 and said clip releasably secures said radio to a preselected primary truncate tube 20 or 22. The free end of clip 50 may be snapped into latch member 52 to increase the security of the grip.

Figure 5:
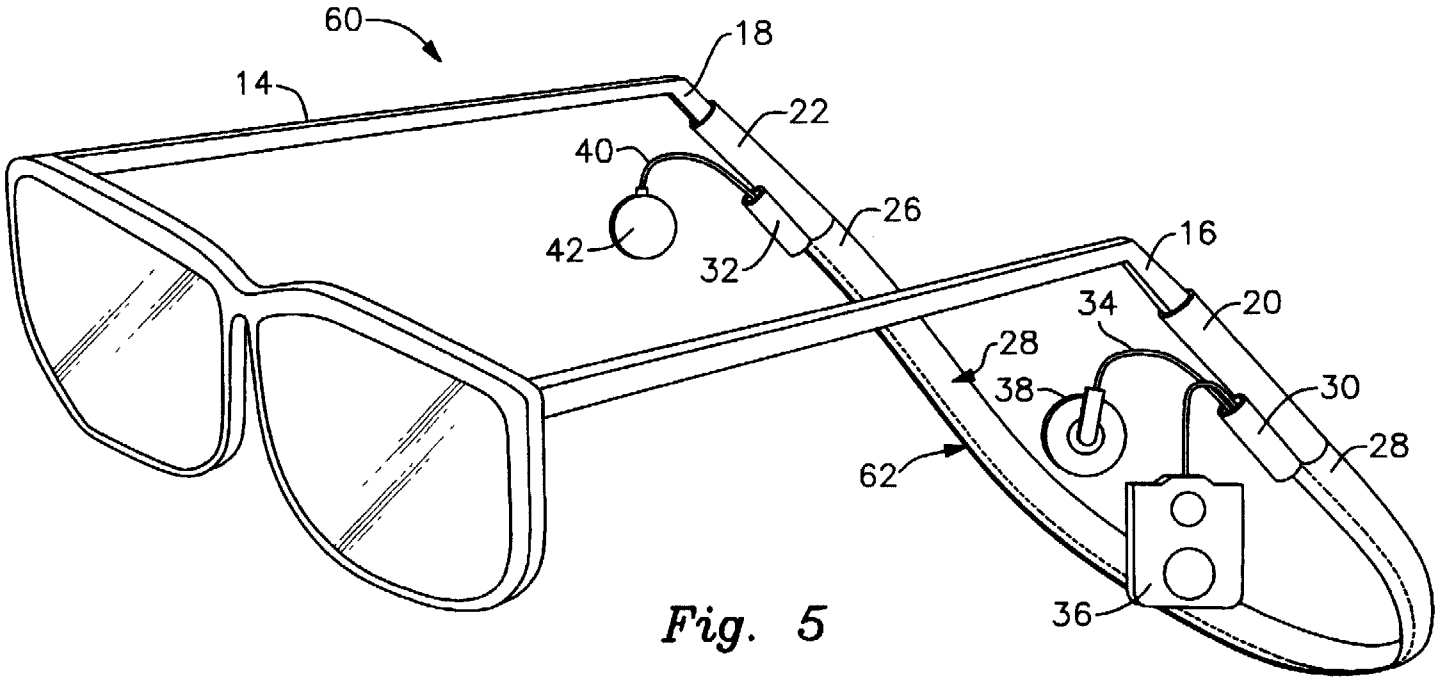
FIG. 5 is a perspective view of a second embodiment of the invention.
Figure 5A:
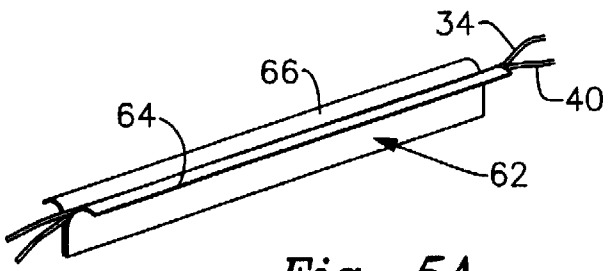
FIG. 5A is a perspective view illustrating a structural detail of said second embodiment.

A second embodiment of the invention, which eliminates the need for exit openings 44 and 46, is depicted in FIGS. 5 and 5A and is denoted 60 as a whole.

In this embodiment, speaker wires 34 and 40 are not positioned within flexible tube 28. Instead, as perhaps best understood in connection with FIG. 5A, they are positioned in a flexible flap member 62 that is formed integrally with and which depends from tube 28 along its extent. Flap member 62 includes a pair of flaps 64, 66 which are initially separated from one another as indicated in FIG. 5A so that speaker wires 34 and 40 may be inserted therebetween. The flaps are then closed to provide the assembly of FIG. 5, it being understood that speaker wires 34 and 40 are inserted through their respective auxiliary tubes 30, 32 prior to positioning of said wires between said flaps. The opposite ends of flap member 62 are positioned adjacent the respective trailing ends of auxiliary tubes 30, 32 so that the respective opposite ends of the speaker wires enter directly into said auxiliary tubes from said flap member, there being no need for exit openings in said elongate, flexible tube 28. Flaps 62, 64 may be permanently adhered to one another by adhesive means, releasably secured to one another by clips or other clamping members, not shown, or they may be releasably secured to one another through the use of hook and loop fasteners attached to opposing faces of said flaps.

Figure 6:
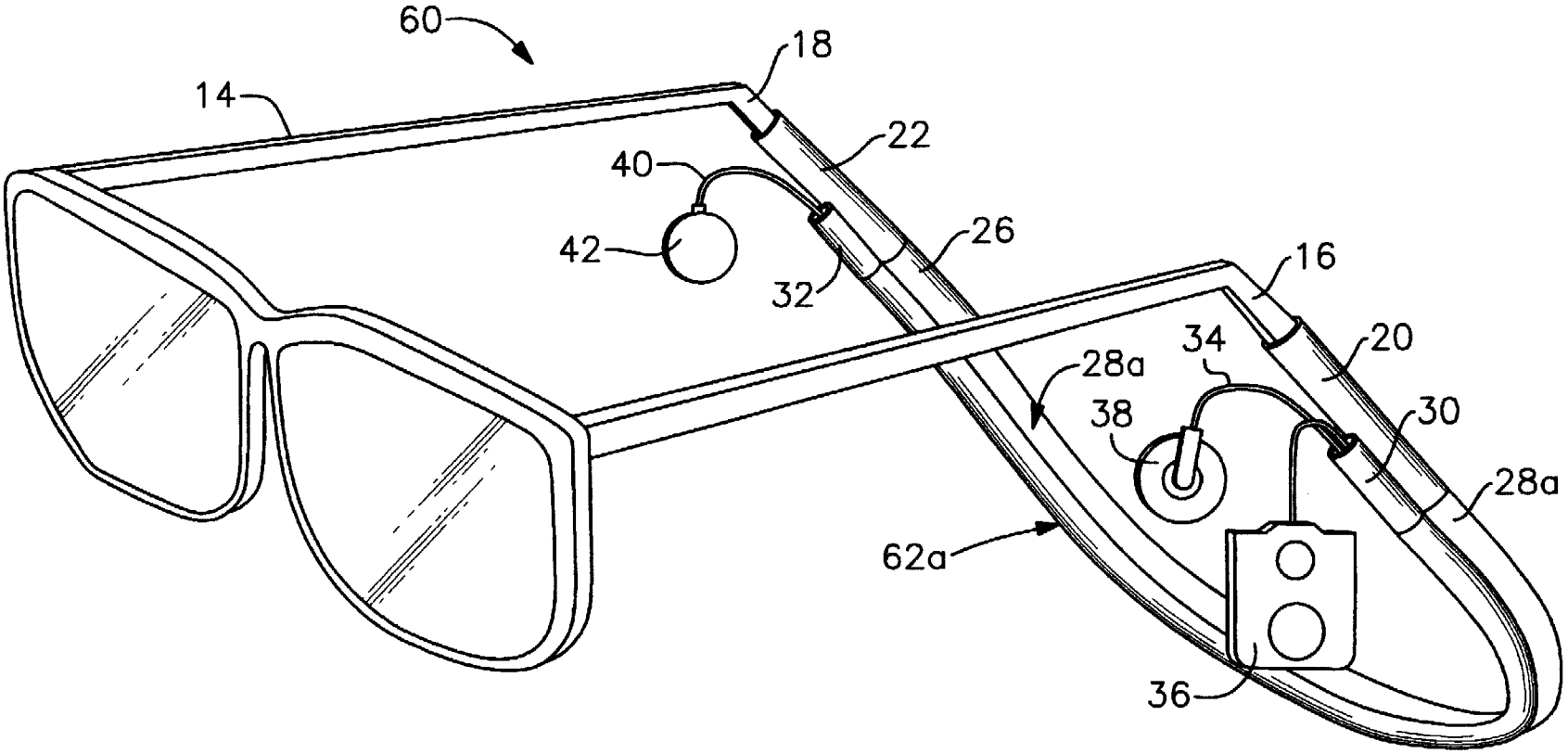
FIG. 6 is a perspective view of another embodiment.

In the embodiment of FIG. 6, elongate, flexible tube 28 is replaced by elongate, flexible rod **28*a*, said rod being a solid member. Tube 28 need not be hollow when the speaker wires are housed in their entireity in said flap 62 and said auxiliary tubes 30, 32. The opposite ends of said elongate, flexible rod 28*a* are still slideably received within truncate primary tubes 20, 22**.

FIG. 6 also depicts an embodiment where flap 62 is replaced by an elongate, flexible tube **62*a* that is attached to elongate, flexible tube or rod 28 or 28*a* along its length. In effect, this joins auxiliary tubes 30, 32 to one another, i.e., single, elongate flexible tube 62*a* for housing speaker wires 34, 40 is secured to elongate flexible tube or rod 28 or 28*a* along its extent. The opposite ends of said flap-substituting tube 62*a* are formed integrally with auxiliary tubes 30, 32**.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described;

What is claimed is:

1. An assembly for releasably attaching a miniature radio to a pair of spectacles, comprising:

a miniature radio;

a pair of speakers positioned remote from said miniature radio;

a pair of speaker wires extending from said miniature radio, a first speaker wire extending from said miniature radio to a first speaker and a second speaker wire extending from said miniature radio to a second speaker;

a pair of truncate primary tubes having leading ends adapted to releasably engage trailing ends of respective ear pieces of said pair of spectacles;

said miniature radio being clipped to a preselected truncate primary tube of said pair of truncate primary tubes;

an elongate, flexible tube extending between respective trailing ends of said truncate primary tubes in interconnecting relationship therewith;

said elongate, flexible tube housing all but opposite ends of said speaker wires;

an opening formed in opposite ends of said elongate, flexible tube adjacent each truncate primary tube;

opposite ends of said speaker wires extending through said openings so that said opposite ends are not received within said truncate primary tubes;

a truncate auxiliary tube attached to each of said truncate primary tubes;

said opposite ends of said speaker wires extending through said truncate auxiliary tubes and being attached to said respective speakers of said pair of speakers so that only said ear pieces occupy said truncate primary tubes when the assembly is attached to a pair of spectacles.

2. An assembly for releasably attaching a miniature radio to a pair of spectacles, comprising:

a pair of ear piece-engaging primary tubes that are adapted to releasably engage respective trailing ends of ear pieces that form a part of said spectacles;

means for releasably clipping said miniature radio to a preselected primary tube of said pair of primary tubes;

an auxiliary tube secured to each primary tube in parallel relation thereto;

an elongate, flexible member having opposite ends that engage respective trailing ends of said primary tubes;

an elongate flap means extending from said elongate, flexible member;

said elongate flap means formed by a pair of opposed flap members;

said elongate flap means having opposite ends disposed adjacent respective trailing ends of said auxiliary tubes;

a pair of speaker wires positioned in sandwiched relation between said flap members;

said pair of speaker wires having opposite ends that extend from said flap members and extend through respective auxiliary tubes to said respective speakers.

3. The assembly of claim 2, wherein said elongate, flexible member is an elongate, flexible tube.

4. The assembly of claim 2, wherein said elongate, flexible member is an elongate, flexible rod.

5. The assembly of claim 2, wherein said flap members are releasably secured to one another.

6. The assembly of claim 2, wherein said flap members are releasably secured to one another by hook and loop fastener members.

7. The assembly of claim 2, wherein said flap members are permanently adhered to one another.

8. An assembly for releasably attaching a miniature radio to a pair of spectacles, comprising:

a pair of ear piece-engaging primary tubes that are adapted to releasably engage respective trailing ends of ear pieces that form a part of said spectacles;

means for releasably clipping said miniature radio to a preselected primary tube of said pair of primary tubes;

an auxiliary tube secured to each primary tube in parallel relation thereto;

an elongate, flexible member having opposite ends that engage respective trailing ends of said primary tubes;

an elongate, flexible tube attached to said elongate, flexible member along its extent;

said elongate, flexible tube having opposite ends disposed adjacent respective trailing ends of said auxiliary tubes;

a pair of speaker wires positioned in said elongate, flexible tube;

said pair of speaker wires having opposite ends that extend from said elongate, flexible tube and extend through respective auxiliary tubes to said respective speakers.

9. The assembly of claim 8, wherein said elongate, flexible member is an elongate, flexible tube.

10. The assembly of claim 8, wherein said elongate, flexible member is an elongate, flexible rod.

11. The assembly of claim 8, wherein said elongate, flexible tube is formed integrally with said auxiliary tubes.

* * * * *